United States Patent [19]

Mann

[11] 4,241,525

[45] Dec. 30, 1980

[54] SWING-AWAY BULLDOZER TEETH ASSEMBLY

[76] Inventor: Donald B. Mann, 8811 131st Ave., NE., Lake Stevens, Wash. 98258

[21] Appl. No.: 933,075

[22] Filed: Aug. 11, 1978

[51] Int. Cl.[2] ..... E02F 3/76

[52] U.S. Cl. ..... 37/117.5; 172/699; 37/DIG. 3; 414/912; 172/748

[58] Field of Search ..... 37/103, 117.5, DIG. 3, 37/118 R, 141 R, 118 A, 141 A; 172/748, 245, 766, 254, 699, 701, 133, 140, 197–198, 276, 801–807; 414/685, 912

[56] References Cited

U.S. PATENT DOCUMENTS

| | | | |
|---|---|---|---|
| 2,262,415 | 11/1941 | Williams et al. | 37/DIG. 3 |
| 3,097,439 | 7/1963 | Calkin | 37/117.5 |
| 3,478,449 | 11/1969 | Baker | 37/117.5 X |
| 3,595,416 | 7/1971 | Perrotti | 37/117.5 X |
| 3,975,844 | 8/1976 | Olson | 37/117.5 |

*Primary Examiner*—E. H. Eickholt

*Attorney, Agent, or Firm*—Seed, Berry, Vernon & Baynham

[57] ABSTRACT

A set of ripping teeth secured to a bulldozer blade in either a deployed or undeployed position. The teeth project from a pair of integrally formed support frames with the upper edge of each frame terminating in respective tubular mounting sleeves. Mounting pin project from the outer ends of the mounting sleeves, and a mounting shaft extends between the inner ends of the mounting sleeves. The mounting pins and the mounting shaft are fixedly received by the mounting sleeves, and they are slidably received by spaced apart hangers which are releasably secured to the blade through blade mounted brackets. In its deployed position, the frames extend downwardly along the front of the blade with the teeth projecting beyond the lower edge thereof. As the bulldozer moves forwardly with the blade lowered, the teeth perform a ripping function in the same manner as teeth which are rigidly secured to the blade. However, as the bulldozer moves rearwardly, the teeth and frames swing forwardly in a floating motion to allow the blade to perform a scraping function while preventing the teeth from fracturing. In its undeployed position, the frame is pivoted to an upwardly projecting position where it is secured in place by a pair of locking hooks releasably secured along the upper edge of the blade.

4 Claims, 6 Drawing Figures

FIG. 3
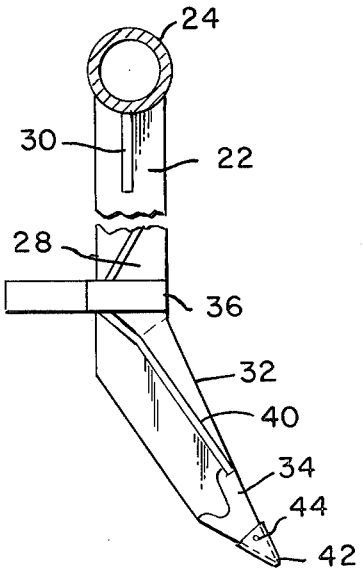
FIG. 4
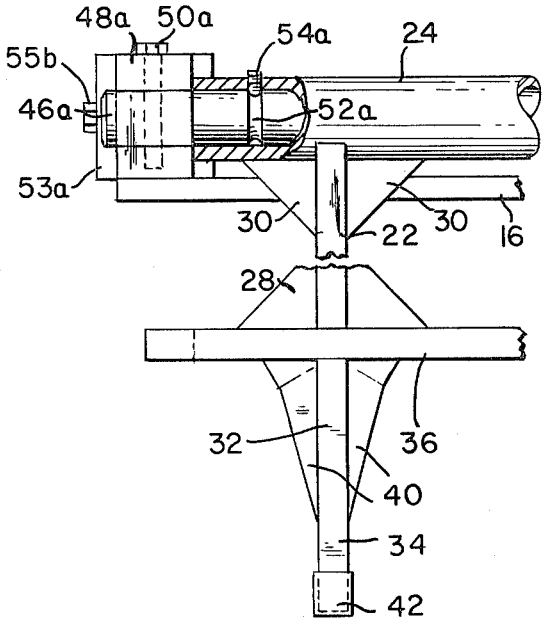
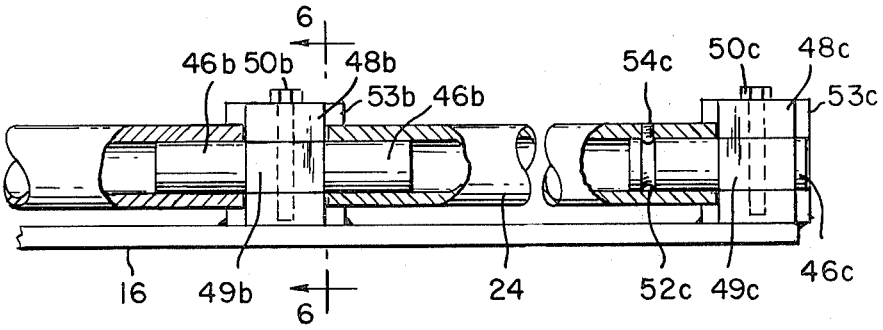
FIG. 5
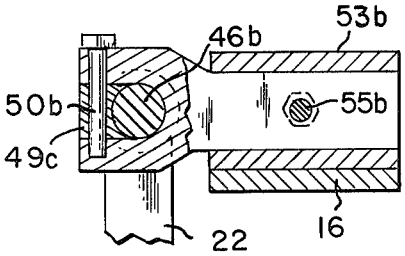
FIG. 6

SWING-AWAY BULLDOZER TEETH ASSEMBLY

BACKGROUND OF THE INVENTION

1. Field of the Invention

This invention relates to bulldozer blade attachments, and more particularly to a set of ripping or raking teeth which may be secured to a bulldozer blade in either a deployed or undeployed position.

2. Description of the Prior Art

Bulldozers having a planar, vertically movable blade secured to their forward ends are commonly used in a variety of applications including ripping or raking in which a layer of rigid surfacing material is removed from an area, and grading in which the lower edge of the blade is scraped along a surface. During the ripping operation, ripping teeth have long been used to allow the blade to dig into the surfacing material. Although ripping teeth may be integrally formed with the lower edge of the blade, in most instances the teeth are individually bolted onto the lower edge of the blade to facilitate removal for the scraping operation and replacement of broken teeth. Although these teeth have generally proven somewhat satisfactory for a ripping operation, they suffer from a number of serious shortcomings. The principal disadvantage of bulldozer blades having conventional ripping teeth is the relatively large amount of time required to convert from a ripping blade to a scraping blade. During a ripping operation after the surfacing material has been broken into pieces, the pieces must be removed from a surface and the surface leveled. With the ripping teeth in conventional use, the teeth must be first removed from the blade or else a separate bulldozer must be used for the grading operation.

Another problem associated with conventional ripping teeth is their inability to withstand rearward forces without fracturing. The ripping teeth generally project forwardly and downwardly from the lower edge of the bulldozer blade and are thus extremely sturdy in receiving forces from in front of the blade since these forces act along the axis of the teeth. However, forces imparted to the teeth from a rearward direction, such as when the bulldozer is moving in a reverse direction with the blade down, produce a force transverse to the longitudinal axis of the teeth which can easily fracture the teeth—thereby necessitating time consuming and expensive replacement. In summary, although conventional ripping teeth are generally satisfactory, they require an excessive period of time to convert from a ripping blade to a scraping blade, and they are not sufficiently resistant to fracture by rearward forces.

Structures have been previously devised for pivotally securing a plurality of elongated members to a bulldozer blade. Examples of such devices are illustrated in U.S. Pat. Nos. 2,132,261; 3,097,439; and 3,595,416. However, these devices are not utilized to easily and quickly convert a conventional bulldozer blade to a ripping blade, and they lack features which are essential for achieving this function. For example, none of the prior art structures include means for positioning the elongated members so that they will not interfere with the use of the blade in a conventional manner.

SUMMARY OF THE INVENTION

It is an object of the invention to provide a bulldozer blade which is easily and quickly converted between a ripping blade and a scraping blade.

It is another object of the invention to provide a set of ripping teeth which cannot be fractured by rearward movement because they kick out and float with the blade in a lowered position.

It is still another object of the invention to provide a set of ripping teeth which may be added onto virtually any size and shape bulldozer blade.

It is still another object of the invention to provide a set of ripping teeth formed in two sections which may be separated for eash of removal, transportaion and storage.

It is a further object of the invention to allow the ripping teeth to be easily cleaned of debris and dirt by lowering the bulldozer's blade while back blading.

These and other objects of the invention are accomplished by a set of ripping teeth projecting from an integrally formed frame which is pivotally secured to the upper edge of the bulldozer blade along a transverse horizontal axis. The ends of the teeth terminate in shanks which are covered by individual tips pinned onto the shank thereby allowing replacement of individual tips. The frame is formed by two separatable sections each of which terminates in a tubular mounting sleeve. Mounting pins project from the outer ends of the mounting sleeves, and a mounting shaft extends between the inner ends of the mounting sleeves. The mounting pins and shaft are secured to hangers which are releasably supported by brackets welded to the blade along the upper edge thereof. In its deployed position the frame extends along the front surface of the blade with the teeth projecting beyond the lower edge of the blade. During the ripping operation the bulldozer moves forwardly with the blade in a lowered position so that the teeth dig into the surface to be removed. The frame is braced against transverse forces by guides projecting rearwardly from the sides of the frame along the sides of the blade. Since the teeth are pivotally secured to the blade rearward movement of the bulldozer with the blade in a lowered position causes the teeth to move forwardly and float with respect to the bulldozer blade in order to prevent the rearward forces from fracturing the teeth. The teeth may be placed in an undeployed position by pivoting them separating the frames and separately upwardly where they are secured in place by a locking hook removably secured to the upper rearface of the blade and extending around a frame member.

BRIEF DESCRIPTION OF THE FIGURES OF THE DRAWINGS

FIG. 3 is a cross-sectional view taken along the line 3—3 of FIG. 2.

FIG. 4 is a front elevational view of a portion of the bulldozer teeth assembly partially broken away.

FIG. 5 is a partial cross-sectional view illustrating the manner in which the tubular support sleeve is pivotally secured to the transverse support shaft.

FIG. 6 is a cross-sectional view taken along the line 6—6 of FIG. 5.

DETAILED DESCRIPTION OF THE PREFERRED EMBODIMENTS

Figure 1:
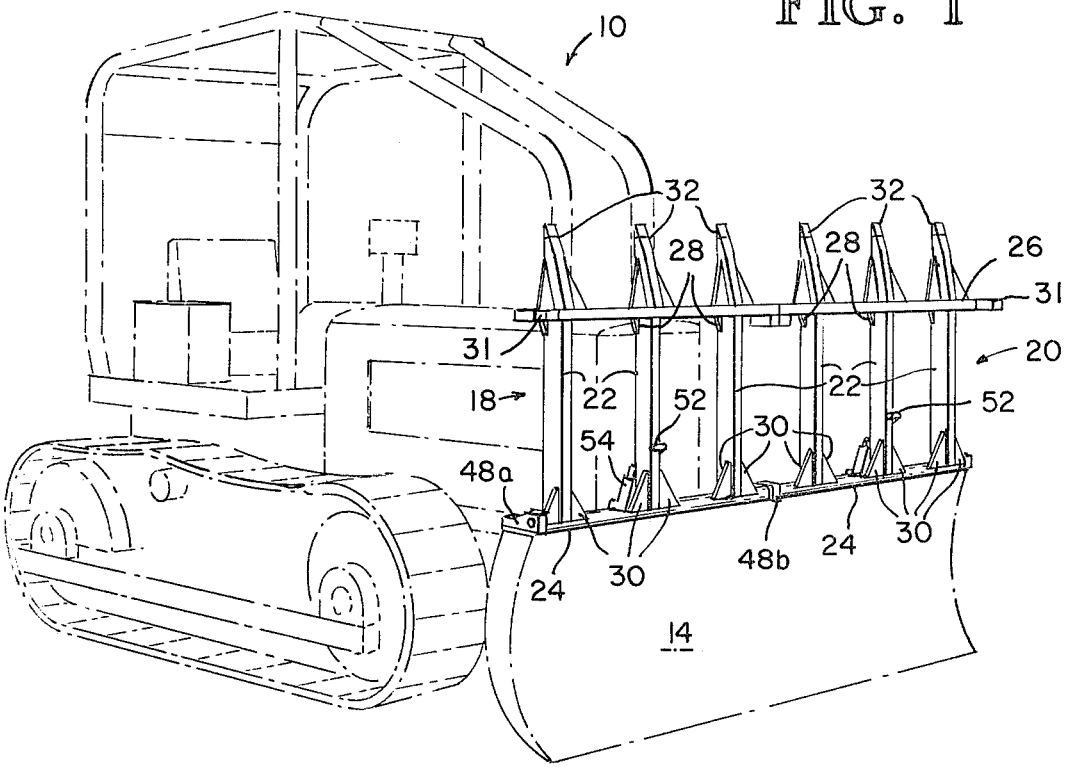
FIG. 1 is an isometric view of the bulldozer teeth assembly mounted on a bulldozer blade in an undeployed position.
Figure 2:
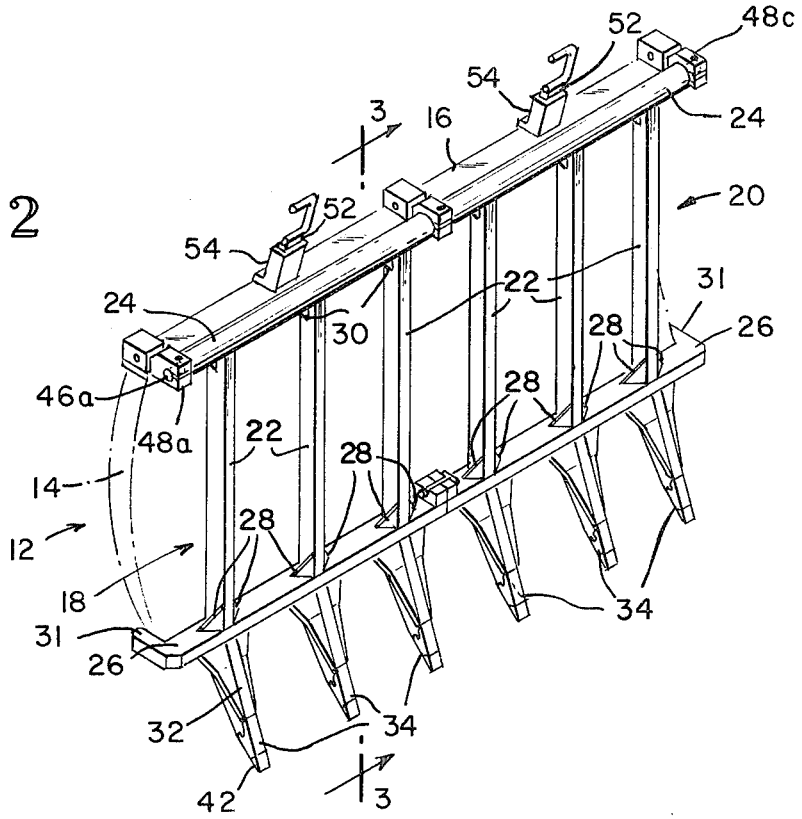
FIG. 2 is an isometric view of the bulldozer teeth assembly.

The swing-away bulldozer teeth assembly, as illustrated in FIGS. 1 and 2, is installed on a conventional bulldozer 10. The bulldozer 10 includes a vertically movable blade 12 or mold board having a curved front surface 14 and a planar top edge 16. The swing-away bulldozer teethassembly includes a pair of frames 18, 20 each of which includes a plurality of rectangular braces 22 extending between tubular mounting sleeves 24 and a rectangular bracing bar 26. Triangular gussets 28 (FIG. 2) are fastened between the braces 22 and bar 26 to further strengthen the frames 18, 20. The gussets 28 are angled rearwardly to deflect dirt and debris. Similarly, triangular gussets 30 (FIG. 1) are fastened between the braces 22 and mounting sleeves 24.

Transverse movement of the frames 18, 20 is restricted by guides 31 projecting rearwardly from the bar 26 along the sides of the blade 14.

The braces 22 extend beyond the bar 26 to form teeth 32. As best illustrated in FIGS. 3 and 4, the teeth 32 have a a rectangular crosssection and terminate in shanks 34 welded onto the teeth 32. Generally triangular gussets 40 are mounted on opposite sides of the teeth 32 between the teeth 32 and bar 26 to provide lateral strength to the teeth 32. A wear resistant tip 42 fits over the end of the shank 34 and is secured in place by a transverse pin 44. The bars 26 of the frames 18, 20 are connected to each other by a locking bolt 45 received by lugs 47 at the inner ends of the bars 26.

As illustrated in FIGS. 1 and 2, pins 46 projecting from the ends of the support sleeves are received by hangers 48 which are welded along the upper edge 16 of the bulldozer blade 12. As best illustrated in FIGS. 4, 5 and 6 the support pins 46 are loosely received in their respective hangers 48 and are retained in place by retaining members 51 and locking pins 50. The hangers 48 are received by brackets 53 which are welded to the blade 14. The hangers 48 are retained in position by bolts 55 extending through the hangers 48 and brackets 53. The support pins 46 are inserted into the sleeves 24 with a circumferential groove 52 formed on the pin 46 aligned with a set screw 54 threaded into a bore in the sleeve 24. As illustrated in FIG. 5, the support structure at the other end of the frame 20 is identical to the support structure for the end of frame 18 illustrated in FIG. 4. The center support for the frames 18, 20 is substantially similar except that the shaft **46*b* project transversely from both sides of the hanger 48*b* and is not secured to the sleeves 24 by set screws. When the set screws 54 are torqued against the pins 46 in the grooves 52 the pins 46 are rigidly secured to the frames 18, 20 so that they rotate within the hangers 48 and are retained in place by the retaining members 51 and pins 50** when the bulldozer teeth assembly is moved between deployed and undeployed positions as explained hereinafter.

The bulldozer teeth are illustrated in their undeployed position in FIG. 1. The frames 18, 20 are rotated in the hangers 48 to a substantially vertical position and are retained in place by hooks 52 having a hooked portion extending around a brace 22 and a shank portion received by a sleeve 54. To lock the bulldozer teeth in their upward, undeployed position the shank of the hook 52 is removed from the sleeve 54 and placed around the brace 22, and the shank of tUe hook 52 is then reinserted in the sleeve 54.

In its deployed position, the bulldozer teeth are allowed to rotate downwardly so that the frames 18, 20 contact the front surface 14 of the blade 12 near the lower edge of the blade 12. As the bulldozer 10 moves forward with the blade 12 lowered, the teeth 32 are highly effective in digging into a surface material. Since the forces on the teeth 32 are received from the front, the positions of the frames 18, 20 remain fixed by the side guides 31 and the position of the blade 12 so that the teeth 32 act as if they are rigidly secured to the lower edge of the blade 12. However, when the bulldozer 10 moves rearwardly with the blade 12 in a lowered position, the forces are imparted to the teeth 32 from the rear causing the frames 18, 20 to swing forwardly and float with respect to the bulldozer blade 12 so that these rearward forces are incapable of fracturing the teeth 32 or shanks 34. Dirt and debris may be cleaned from the teeth by moving the bulldozer rearwardly while raising and lowering the blade.

I claim:

1. A set of bulldozer teeth adapted to be secured to a bulldozer blade in either a deployed or undeployed position, comprising:

a rigid, rectangular frame;

fastening means for pivotally securing a first edge of said frame adjacent the upper edge of said bulldozer blade, said fastening means including a tubular mounting sleeve secured to the first edge of said frame and a pair of forwardly projecting hangers fastened to the upper edge of said blade at opposite sides thereof, each of said hangers receiving a pin projecting from opposite ends of said mounting sleeve such that said frame may be pivoted between said deployed position in which said frame lies along the front face of said blade and said undeployed position in which said frame projects upwardly above the upper edge of said blade;

a plurality of teeth extending from a second edge of said frame opposite said first edge, said teeth projecting away from said frame beyond the lower edge of said bulldozer blade when said frame is in its deployed position; and locking means for releasably securing said frame in its undeployed position.

2. The bulldozer teeth of claim 1 wherein said hangers are releasably received by brackets, said brackets being fixedly secured to said bulldozer blade along the upper edge thereof.

3. The bulldozer teeth of claim 1 wherein said pins are slidably received in said hangers, and the inwardly projecting ends of said pins have a circumferential groove formed therein receiving a respective set screw threaded in a bore through said support sleeve, said set screws forceably contacting said pins within said grooves to fixedly secure said pins to said sleeve while allowing said pins to rotate in said hangers.

4. A set of bulldozer teeth adapted to be secured to a bulldozer blade in either a deployed or undeployed position, comprising:

a rigid, rectangular frame;

fastening means for pivotally securing a first edge of said frame adjacent the upper edge of said bulldozer blade such that said frame may be pivoted between said deployed position in which said frame lies along the front face of said blade and said undeployed position in which said frame projects upwardly above the upper edge of said blade;

a plurality of teeth extending from a second edge of said frame opposite said first edge, said teeth projecting away from said frame beyond the lower edge of said bulldozer blade when said frame is in its deployed position; and locking means for releasably securing said frame in its undeployed position including an upwardly projecting, tubular locking sleeve secured to said sleeve adjacent the upper edge thereof, and a locking hook having a curved portion engaging said frame and a shank portion inserted in said locking sleeve such that said frame may be released from its locking position by removing said shank portion from said locking sleeve and disengaging said hook from said frame.

* * * * *